US011491538B2

(12) United States Patent
Baker et al.

(10) Patent No.: US 11,491,538 B2
(45) Date of Patent: Nov. 8, 2022

(54) MULTIFUNCTIONAL HIGH STRENGTH METAL COMPOSITE MATERIALS

(71) Applicant: Martha Elizabeth Hightower Baker, Spring, TX (US)

(72) Inventors: Dean M Baker, Cypress, TX (US); Henry S Meeks, Roseville, CA (US)

( * ) Notice: Subject to any disclaimer, the term of this patent is extended or adjusted under 35 U.S.C. 154(b) by 0 days.

(21) Appl. No.: 14/948,204

(22) Filed: Nov. 20, 2015

(65) Prior Publication Data

US 2016/0175931 A1 Jun. 23, 2016

Related U.S. Application Data

(63) Continuation of application No. 12/974,863, filed on Dec. 21, 2010, which is a continuation-in-part of (Continued)

(51) Int. Cl.
*B22F 3/17* (2006.01)
*B22F 3/04* (2006.01)

(Continued)

(52) U.S. Cl.
CPC ..... *B22F 1/0003* (2013.01); *B22F 1/16* (2022.01); *B22F 1/17* (2022.01); *B22F 3/04* (2013.01);

(Continued)

(58) Field of Classification Search
CPC ..... B22F 1/17; B22F 1/16; B32B 15/20
See application file for complete search history.

(56) References Cited

U.S. PATENT DOCUMENTS 3,150,936 A * 9/1964 Hunt ..... B21C 23/01 428/656
3,264,073 A * 8/1966 Schmitt ..... B22F 1/0051 264/29.6

(Continued)

OTHER PUBLICATIONS

Aluminum, http://web.archive.org/web/20020603153546/ http://www.aluminyumsanayi.com/aluwebsayfam2.html, Jun. 3, 2002, pp. 1-4.

(Continued)

*Primary Examiner* — Adam Krupicka
(74) *Attorney, Agent, or Firm* — Alberto Q. Amatong, Jr.; Amatong McCoy LLC

(57) ABSTRACT

A method of producing composites of micro-engineered, coated particulates embedded in a matrix of metal, ceramic powders, or combinations thereof, capable of being tailored to exhibit application-specific desired thermal, physical and mechanical properties, such as High Altitude Exo-atmospheric Nuclear Standard (HAENS) I, II or III radiation protection, to form substitute materials for nickel, titanium, rhenium, magnesium, aluminum, graphite epoxy, and beryllium. The particulates are solid and/or hollow and may be coated with one or more layers of deposited materials before being combined within a substrate of powder metal, ceramic or some combination thereof which also may be coated. The combined micro-engineered nano design powder is consolidated using novel solid-state processes that prevent melting of the matrix and which involve the application of varying pressures to control the formation of the microstructure and resultant mechanical properties.

25 Claims, 8 Drawing Sheets

Related U.S. Application Data application No. 12/427,486, filed on Apr. 21, 2009, now Pat. No. 8,535,604.

(60) Provisional application No. 61/125,243, filed on Apr. 22, 2008.

(51) Int. Cl.

| | |
|---|---|
| ***B22F 3/24*** | (2006.01) |
| ***B22F 1/00*** | (2022.01) |
| ***B22F 1/16*** | (2022.01) |
| ***B22F 1/17*** | (2022.01) |
| ***B22F 3/10*** | (2006.01) |
| ***B22F 3/105*** | (2006.01) |
| ***B22F 3/15*** | (2006.01) |
| ***B22F 3/20*** | (2006.01) |
| ***B22F 3/22*** | (2006.01) |
| ***B22F 9/04*** | (2006.01) |

(52) U.S. Cl.

CPC ..... *B22F 3/105* (2013.01); *B22F 3/1035* (2013.01); *B22F 3/15* (2013.01); *B22F 3/17* (2013.01); *B22F 3/20* (2013.01); *B22F 3/22* (2013.01); *B22F 3/225* (2013.01); *B22F 3/24* (2013.01); *B22F 9/04* (2013.01); *B22F 2003/1051* (2013.01); *B22F 2003/242* (2013.01); *B22F 2003/247* (2013.01); *B22F 2003/248* (2013.01); *B22F 2998/10* (2013.01); *B22F 2999/00* (2013.01); *Y10T 428/12014* (2015.01)

(56) References Cited

U.S. PATENT DOCUMENTS

| | | | | |
|---|---|---|---|---|
| 3,655,425 | A | | 4/1972 | Longo et al. |
| 3,752,685 | A | | 8/1973 | Honda et al. |
| 4,303,732 | A | | 12/1981 | Torobin |
| 4,453,081 | A | | 6/1984 | Christ et al. |
| 4,624,865 | A | | 11/1986 | Gindrup et al. |
| 4,655,852 | A | * | 4/1987 | Rallis ..... C23C 14/16 427/398.1 |
| 4,939,038 | A | | 7/1990 | Inabata |
| 5,070,591 | A | | 12/1991 | Quick et al. |
| 5,271,749 | A | | 12/1993 | Rai et al. |
| 5,588,477 | A | * | 12/1996 | Sokol ..... B22D 19/14 164/34 |
| 5,601,924 | A | | 2/1997 | Beane et al. |
| 5,786,785 | A | | 7/1998 | Gindrup et al. |
| 5,892,476 | A | | 4/1999 | Gindrup et al. |
| 5,965,829 | A | | 10/1999 | Haynes et al. |
| 6,024,915 | A | * | 2/2000 | Kume ..... B22F 1/02 419/35 |
| 6,630,008 | B1 | | 10/2003 | Meeks et al. |
| 6,656,587 | B2 | | 12/2003 | Johnson et al. |
| 6,709,739 | B1 | | 3/2004 | Mullen et al. |
| 6,752,938 | B2 | | 6/2004 | Wang et al. |
| 6,831,223 | B2 | | 12/2004 | Kamata et al. |
| 6,849,186 | B2 | | 2/2005 | Johnson et al. |
| 6,852,272 | B2 | | 2/2005 | Artz et al. |
| 6,864,297 | B2 | | 3/2005 | Nutt et al. |
| 6,919,063 | B2 | | 7/2005 | Jang et al. |
| 7,498,077 | B2 | | 3/2009 | Joseph et al. |
| 8,573,295 | B2 | | 11/2013 | Johnson et al. |
| 2003/0180171 | A1 | | 9/2003 | Artz et al. |
| 2005/0260093 | A1 | | 11/2005 | Artz et al. |
| 2006/0096734 | A1 | * | 5/2006 | Czerwinski ..... B22D 27/003 148/420 |
| 2009/0074604 | A1 | | 3/2009 | Chen et al. |
| 2013/0098203 | A1 | | 4/2013 | Sherman et al. |
| 2014/0004270 | A1 | | 1/2014 | Sherman et al. |

OTHER PUBLICATIONS

Mordike et al., Magnesium Properties—applications—potential, 2001, Elsevier, Materials Science and Engineering A, vol. 301, pp. 37-45.

Maerials Aluminum Oxide (Al2O3) Properties, May 20, 2006, http://web.archive.org/web/20060520195437/http://accuratus.com/alumox.html, 3 pages.

* cited by examiner

MULTIFUNCTIONAL HIGH STRENGTH METAL COMPOSITE MATERIALS

CROSS REFERENCE TO RELATED APPLICATION

The present application is a Continuation of U.S. application Ser. No. 12/974,863, filed Dec. 21, 2010, which is a Continuation-In-Part Application of U.S. patent application Ser. No. 12/427,486, filed Apr. 21, 2009 (now U.S. Pat. No. 8,535,604, issued on Sep. 17, 2013), which claims the benefit of U.S. Provisional Application No. 61/125,243, filed Apr. 22, 2008, which disclosure is hereby incorporated by reference for all purposes and made a part of the present disclosure.

GOVERNMENT RIGHTS CLAUSE

The U.S. Government has a paid-up license in this invention and the right in limited circumstances to require the patent owner to license others on reasonable terms as provided for by the terms of Missile Defense Agency SBIR Contracts HQ0006-06-C-7351 and HQ0006-07-C7601.

FIELD OF THE INVENTION

The invention relates to the composition and manufacture of metals, alloys, metal matrix or cermet composites and composite materials.

BACKGROUND OF THE INVENTION

Prior art in the field of metal matrix composites is primarily focused on providing a material for use as a metal substitute to provide a single desired property-light weight. These composites are typically manufactured by adding un-coated particles or through use of open or closed cell foam technology. The emphasis in prior art composite technology is placed on reducing only the weight of the structure, and not in optimizing or modifying the underlying properties of the material so as to impart an application-specific quality such as High Altitude Consequently, prior art metal composites are light, but do not have the strength, durability or stiffness necessary to compete against materials such as beryllium or aluminum. Closed cell foams are generally very weak, under 5-10 ksi tensile strength, have a poor surface finish, and are not easily machined. Likewise, joining and attaching these composites have inherent technical problems including low quantity processing capability.

Prior art in shielding of metals has been limited to preventing low level electromagnetic interference by a physical attachment of heavy metal cladding such as nickel, but not in preventing x-ray radiation, prompt nuclear dose, or neutron absorption by use of a micro-engineered composite having the capability inherent to the core composite. In the past, these capabilities have been added through coatings or gluing metal shields of Tungsten on to a previous material.

In addition, prior art utilizing microspheres to form a metal matrix composite involves consolidation using high heat/molten processes and extrusion techniques. High heat causes inter-facial reactions and associated detrimental effects due to oxidation of the molten matrix. Taking the matrix to a molten state creates the possibility of an oxygen reactive liquid phase and allows the matrix to reach a fluid state in which the microspheres can float, melt or segregate within the matrix. High heat/molten processing requires special handling in instances involving molten magnesium and aluminum due to their tendency to react violently in air, thereby also increasing the cost and risk associated with these methods. Other prior art approaches for consolidating composite powders involve forging within a bed of heated, granular particles, typically graphitic in nature. In this process, a less than fully dense article is placed within a heated bed of graphitic powder and pressure is applied without control to the graphite bed via a hydraulic driven ram. During the process, large anisotropic strains are introduced which cause significant particle deformation. During this process, there is no attempt to control the critical pressurization phase of the forging process.

Accordingly, there is a need in the art for a method of producing metal matrix composite materials that: 1) produces light weight composites which consistently and predictably exhibit certain specific desired properties; and 2) a method that avoids both the risk and expense of high-heat molten consolidation processes, and 3) the anisotropic strains that cause significant particle deformation in typical forging techniques. Ideally, such composites would predictably and consistently exhibit application specific qualities (for example for use in military components that require High Altitude Exo-atmospheric Nuclear Standard (HAENS) I, II or III radiation hardened materials and/or materials resistant to an Electromagnetic Pulse) and have a lighter mass than nickel, titanium, magnesium, aluminum, graphite epoxy, and beryllium, or their alloys, thereby providing a truly satisfactory substitute for these materials.

SUMMARY OF THE INVENTION

The inventive Multifunctional High Strength Metal Composite Materials of the present application are formed utilizing a novel method to compress micro-engineered particulate(s) and exhibit predictable, desired application specific properties. The method comprises one or more of the steps of: 1) selecting at least one micro-engineered particulate; 2) mixing the particulate with a powder substrate of various grain or particle sizes to form a nano design powder; 3) pre-consolidating the nano design powder to form a near net shape article; and, 4) consolidating the near net shape article utilizing novel processes into a metal matrix composite exhibiting the desired application specific property(ies). It should be noted that all steps may not be necessary to produce the desired result. The desired properties to control include, without limitation, radiation hardening, X-ray shielding, neutron shielding, combined radiation shielding/HAENS I, II or III protection, EMI shielding, corrosion resistance, modulus enhancement, reduced density, thermal expansion control, thermal conductivity control, controlled tensile strength, variable specific strength, and improved surface finish.

The particulate is selected from the group consisting of hollow microspheres and solid microspheres/particles or may be a combination of the two. Material for the particulate is selected from the group consisting of metals, alloys and ceramics. The particulate may further have at least one coating applied to encapsulate it, each of said coating materials selected from the group consisting of metals, alloys and ceramics. Consequently, the particulate may comprise a combination of coated hollow and solid microspheres/particles.

The powder substrate is selected from the group consisting of metals, alloys, polymers and ceramics. The powder substrate also may be coated with at least one material selected from the group consisting of metals, alloys and ceramics.

The pre-consolidating step comprises a pressing technique selected from the group consisting of: pressing in a hard die, Cold Isostatic Pressing, metal injection molding, or other powder consolidation/compaction processes. One consolidating step comprises a novel dual-mode Dynamic Forging technique to increase the density of the near net shape article. The Dynamic Forging of the present application comprises the steps of: 1) in a first mode, applying a pressure to the near net shape article in a range of 5 to 200 Tons within a heated pressure transmitting media while maintaining a temperature from 100 degrees Centigrade to 1400 degrees Centigrade; 2) during the first mode, maintaining the temperature below a melting point of a material used to form the micro-engineered particulate, the powder substrate, and any coatings applied thereto; 3) in a second mode, applying a pressure to the near net shape article in a range of 2 to 2500 Tons within a heated pressure transmitting media while maintaining a temperature range of 100 degrees Centigrade to 1400 degrees Centigrade; 4) during the second mode, maintaining the temperature below a melting point of a material used to form the micro-engineered particulate, the powder substrate, and any coatings applied thereto; 5) controlling the rate of the applied pressure during the first and second modes by means including but not limited to, integrated hydraulic valves, electrical relays and mechanical limit switches; 6) controlling the pressurization rates in the range of 2"/min to 120"/min; and, 7) controlling the decompression rate so as not to exceed 120"/min.

The method may further include the steps of: 1) post processing the metal matrix composite through a technique selected from the group consisting of: coating, extruding, machining, polishing, coating, anodizing, heat treating; and, 2) machining the metal matrix composite into an article having the final desired shape.

BRIEF DESCRIPTION OF THE DRAWINGS

The invention is described in more detail with reference to the attached drawings and photographs, in which.

DETAILED DESCRIPTION OF THE ILLUSTRATIVE EMBODIMENT

Figure 1:
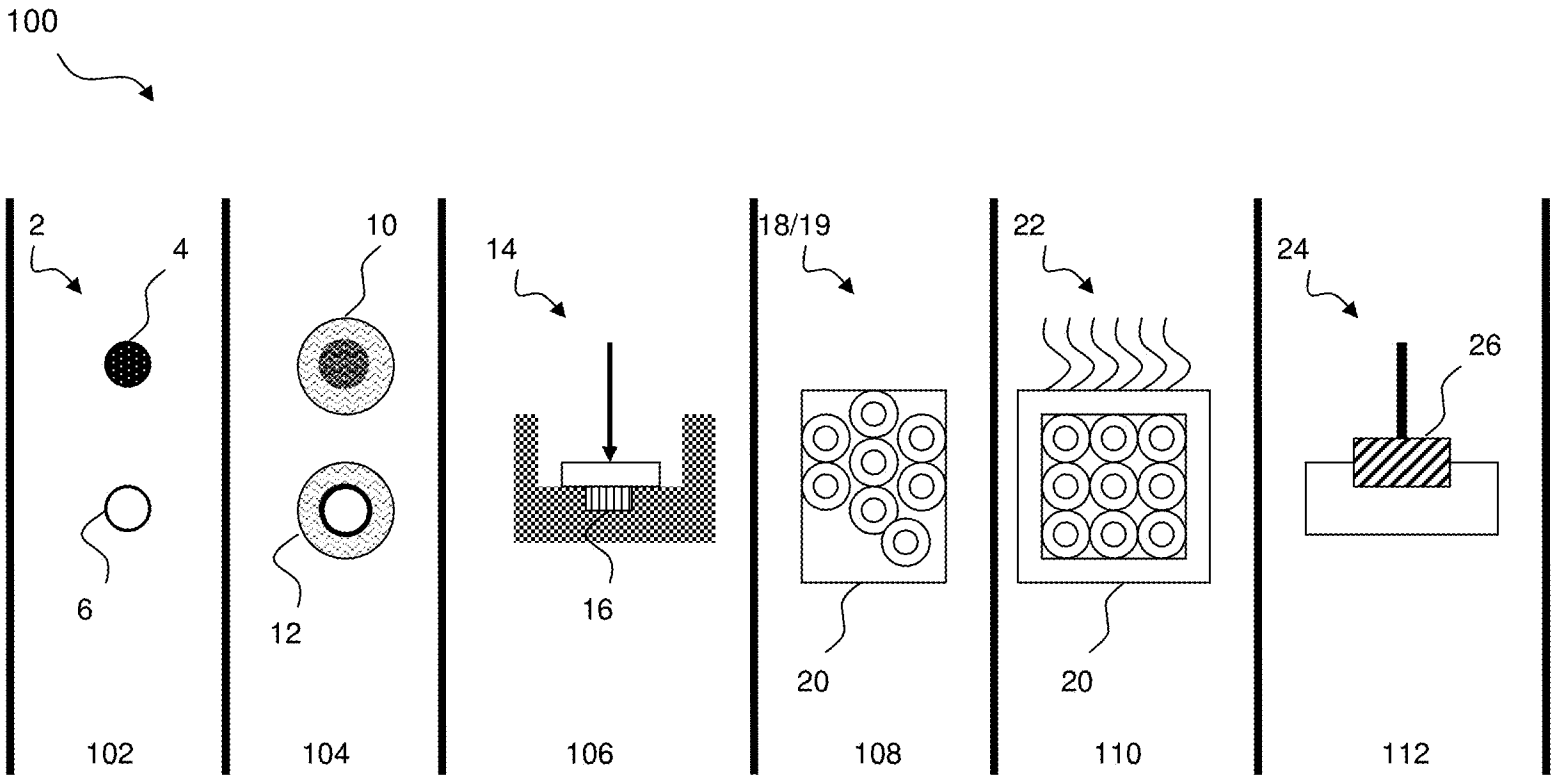
FIG. 1 is a schematic drawing of steps in the method of producing the property specific metal matrix composites, according to the invention.

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

In general, the inventive Multifunctional High Strength Metal Composite Materials of this application are composite materials and structures made therefrom that are lighter, stronger and possess application specific properties or capabilities not seen in conventional composite structures. These application specific controllable capabilities include, but are not limited to, integrated radiation shielding from nuclear events (HAENS I, II or III), corrosion resistance, electromagnetic shielding (EMI), high stiffness, wear resistance, and thermal conductivity.

The novel composite materials comprise composites of micro-engineered, coated particulates embedded in a matrix of metal or ceramic powders, or combinations thereof. The particulates may be solid and/or hollow and may be coated with one or more layers of deposited materials before being combined within a substrate of powder metal, ceramic or some combination thereof which also may be coated. The combined micro-engineered nano design powder is then consolidated using novel solid-state processes that require no melting of the matrix. The consolidation processes are conducted at select temperatures to assure that the melting point of any of the materials involved is never reached. The consolidation process also involves the application of varying pressures to control the formation of the microstructure and resultant mechanical properties. By utilizing only solid-state processes, there are no inter-facial reactions with the microspheres and no detrimental effects due to oxidation of a molten matrix. No matrix is fluidized during consolidation, therefore the microspheres cannot float or segregate within the matrix during processing. In addition, due to the relatively low temperatures involved for some materials, there is no risk of creating an oxygen reactive liquid phase. For example, molten magnesium and aluminum react violently when exposed to air; the present processes eliminate this risk.

As compared with the prior art, the resulting method is unique in the use of micro-engineered, hollow and/or coated particles consolidated through solid-state processes into useable articles having a variety of application specific properties. The thermal, physical and mechanical properties of composite articles produced by the disclosed method are superior to those obtained using current state-of-art, conventional alloys, or metal and ceramic matrix composites.

In general, the method for manufacturing the inventive composite structures comprises the following steps:

1) Selection and/or custom manufacturing of hollow spheres or microballoons (metallic or ceramic in nature), and solid powder(s) (ceramic, metal or alloy or various grain or particles sizes achieved through milling or other powder modification techniques) as may be employed by the design for the matrix;
2) Encapsulating or coating the hollow spheres or microballoons, and/or solid powder with materials that will enhance inter-particle bonding, structural integrity, provide shielding from diverse radiation sources (Neutron, X-Ray, Electron, Proton, etc.), stiffness, reduce weight, and provide other application specific properties as desired. The coating layer may be one layer or multiple layers of the same or varying materials. The layers may be metallic, alloys, co-deposited layers, or ceramic in nature;
3) Pre-consolidating or otherwise forming the powders into a less than fully dense article via micro balloons alone or a mixture of powders, or coated powders with the microballoons via regular pressing in a hard die, Cold Isostatic Pressing (CIP) in an elastomer mold or bag, metal injection molding (MIM) or other techniques to form a near net shape article; and,
4) Consolidating (increasing density) the composite to the desired level appropriate for the specific composition and desired application utilizing novel processes such as Dynamic Forging. The resulting strength, microstructure and density is determined by both the composite formulation and processing route used for consolidation.

The method may further include post processing through coating, extruding, machining, polishing, anodizing, heat treating, laser treatment and/or other processes used to modify the surface, microstructure or thermal, physical or mechanical properties of the fabricated article; and, machining, grinding, water jet cutting, EDM'd (electro-chemical discharge machining), polishing and/or other processing of the article into a final desired shape.

Potential applications for the novel structures include replacement of toxic metals such as expensive beryllium. Similar replacement of less expensive metals such as aluminum, magnesium, titanium, nickel, tungsten, tantalum, ceramic glass, and other metallic or ceramic materials is possible.

Selection of Particulates

FIG. 1 shows a series of exemplary steps 100 in the method of manufacturing the Property Specific Metal Matrix Composites, according to the invention. Referring to FIG. 1, and starting with step 102, particulates 2 are selected based, at least in part, on the desired quality(ies) for the resulting composite. The particulates 2 may comprise solid 4 and/or hollow 6 materials, including without limitation, a ceramic hollow sphere, a metal hollow sphere, a solid metal powder or a solid ceramic powder of 0.05 to 1000 microns in diameter. The ceramic may be, but is not limited to, a carbide, oxide, nitride and/or boride for example.

The spheres may be custom manufactured or purchased as hollow spheres or micro balloons (metallic and/or ceramic in nature), and solid powder(s) (ceramic, metal and/or alloy) as desired. The microspheres provide a controlled surface and are scaleable. Particulate materials include, but are not limited to, one or more, metals, alloys, ceramics, and/or elements from Groups 1 through 15 of the Periodic Table of the Elements.

Coating Application

Referring to step 104 of FIG. 1, the chosen particulates 2 may be coated with single or multiple layers of ceramics, elements, or metals, the layers being 1 nm to 20 microns thick, as further discussed in connection with FIG. 2. Up to 14 layers have been achieved to better control specific properties, but any suitable or desired number of layers may be applied. The coating layers may be metallic, alloys, elements, co-deposited layers, and/or ceramic in nature, and coating materials include, without limitation, Carbon, Lead, Tungsten, Rhenium, Tantalum, Niobium and Boron. The encapsulated or coated hollow spheres and/or solid powders have enhanced inter-particle bonding and structural integrity, resulting in controllable effects on tensile strength and ductility. They also are capable of providing shielding from diverse radiation sources and can provide other application-specific properties as desired.

Combining Particulates with Powder Substrate

Referring to step 106 of FIG. 1, the particulates 2 are combined with a powder substrate to form a nano design powder that is subjected to a pre-consolidation 14 process for creation of a near net shape article 16. The powder substrate may comprise any one or more desired or suitable substances that will predictably provide or contribute to one or more application-specific properties for the resulting metal matrix composite. Powder substrate materials include, but are not limited to, metals, alloys, polymers, ceramics, elements from Groups 1 through 15 of the Periodic Table of the Elements (including Lithium, Magnesium, Titanium, Rhenium and Tantalum), single wall nanotubes, multi-wall nanotubes, chopped fiber, milled fiber, hydrides, carbon fiber, aromatic polyamide fibers, poly(p-phenylene-2,6-benzobisoxazole, polyethelyne, polypropylene, acetyl, nylon, polycarbonate, polyetherketone, polytherimide, polyethylene teraphthalate, polysulfide, aromatic polyester, whiskers, carbon, allotropic carbon, graphite, vitreous carbon, diamond, amorphous carbon, glass, borosilicate glass, aluminosilicate micro spheres, cenospheres, carbide, silicon carbide, boron, tungsten carbide, aluminum oxide, beryllium, beryllium powder, beryllium flake, beryllium chips, beryllium oxide, beryllium copper, beryllium alloys, zirconia, silicon nitride, cubic born nitride, hexagonal boron nitride, aluminum nitride, beryllium nitride, silicon hexaboride, tetra boride, lanthanum boride, niobium boride, lithium boride, alumina, magnesium oxide and/or yttrium. The polymers used may be thermoplastic, thermosetting, crystalline, semi-crystalline, amorphous, or cross-linking. The polymers may be subject to supplemental processing, for example the addition of macro cyclic oligoesters to improve viscosity, or polyhedral oligomeric silsesquioxanes to improve properties.

One or more of the powder substrate materials also may be coated with one or more layers of materials selected from the group consisting of metals, alloys, elements, polymers and/or ceramics. The coating materials include, but are not limited to, metals, alloys, polymers, ceramics, elements from Groups 1 through 15 of the Periodic Table of the Elements (including Lithium, Magnesium, Titanium, Rhenium and Tantalum), single wall nanotubes, multi-wall nanotubes, chopped fiber, milled fiber, hydrides, carbon fiber, aromatic polyamide fibers, poly(p-phenylene-2,6-benzobisoxazole, polyethylene, polypropylene, acetyl, nylon, polycarbonate, polyetherketone, polytherimide, polyethylene teraphthalate, polysulfide, aromatic polyester, whiskers, carbon, allotropic carbon, graphite, vitreous carbon, diamond, amorphous carbon, glass, borosilicate glass, aluminosilicate micro spheres, cenospheres, carbide microspheres, carbides, oxides, nitrides, silicon carbide, boron, tungsten carbide, aluminum oxide, beryllium, beryllium powder, beryllium flake, beryllium chips, beryllium oxide, beryllium copper, beryllium alloys, zirconia, silicon nitride, cubic born nitride, hexagonal boron nitride, aluminum nitride, beryllium nitride, silicon hexaboride, tetra boride, lanthanum boride, niobium boride, lithium boride, alumina, magnesium oxide and/or yttrium. The particulates may vary in grain or particle size and may be greater or less in size than the substrate materials.

Pre-Consolidation

Referring again to step 106 of FIG. 1, the nano design powder (particulates combined with the powder substrate) is pre-consolidated 14 into a less than fully dense article 16 via regular pressing in a hard die, Cold Isostatic Pressing (CIP) in an elastomer mold or bag, metal injection molding (MIM), "canning" or other suitable techniques.

Dynamic Forging

Referring to step 108 of FIG. 1, the near net shape article is consolidated 18/19 to form a metal matrix composite 20 having increased density over the pre-consolidation step, and uniformity to the desired level appropriate for the specific composition and desired application. The resulting strength, microstructure and density of the composite 20 is determined by both the composite formulation and processing route used for consolidation 18/19. In the preferred mode, the near net shape article is consolidated utilizing Dynamic Forging 18/19, a novel dual mode process discussed further in connection with FIG. 4. Alternately, other or additional consolidation processes may be utilized individually or in combination, including, P/M forging, Hot Isostatic Pressing (HIP), Laser Processing, sintering, pulse sintering, ARCAM, Metal Injection Molding, Laser-engineered Net Shaping (LENS), conventional forging in a mold, Spark Plasma Sintering (SPS), rapid pressure molding, plasma or other thermal spray process, E-Beam Process, Liquid Phase Sintering (with or without pressurization), vacuum hot pressing, Hot Isostatic Pressing, Electro-consolidation, extrusion and ECAP extrusion. In the case of SPS and laser processing, the matrix is vaporized or melted then rapidly solidified or re-condensed on core particle surfaces.

The advantages to utilizing coated particles and powders during consolidation include: 1) the ability to preform with near net shape pressing; 2) high compaction strength and density; 3) no processing toxicity; 4) control over phases; 5) minimizes segregation; and, 6) control over composition and chemical interactions, including control over resultant physical, mechanical, thermal, electrical, radiation and other material properties of the consolidated composite.

Post Treatment

Referring to step 110 of FIG. 1, the metal matrix composite 20 may be subjected to post-consolidation processing 22 through coating, extruding, machining, polishing, anodizing, heat treating and/or other processes used to modify the surface, microstructure and/or thermal, physical or mechanical properties of the fabricated article 20. The primary goal of post treatment 22 is to increase and control the ductility or other specific properties of the final parts.

Final Machining

Referring to step 112 of FIG. 1, the composite material 20 may be machined 24, ground, EDM'd (electro-chemical discharge machining), water jet cut, polished and/or subjected to other processing to form an article having a final desired shape 26. The time and effort involved in machining is limited due to the near net shape 16 achieved in step 106 of FIG. 1. In addition, the use of the nano design powder 32 (shown in FIG. 4) permits the creation of composites 20 having extremely thin walls if desired. Porosity in the final material ranges from 90% by volume to a fully densified matrix composite.

The steps shown in FIG. 1 are exemplary, only, and in certain circumstances all steps described in FIG. 1 are not necessary to produce the novel composites of this application. For example, the step of preconsolidation is not necessary in Spark Plasma Sintering (SPS). As another example, the mixing of particulates 2 with powder substrate is not necessary where only one coated particulate 2 (without substrate) is utilized. In addition, the method may be modified by addition of specific elements to create or modify the composition via chemical or thermal reactions. For example, a carbon coating may be applied with conversion on W or Ta particles or a W coating; then a heat treat is performed to create WC or TaC or substoichiometeric versions.

Figure 2:
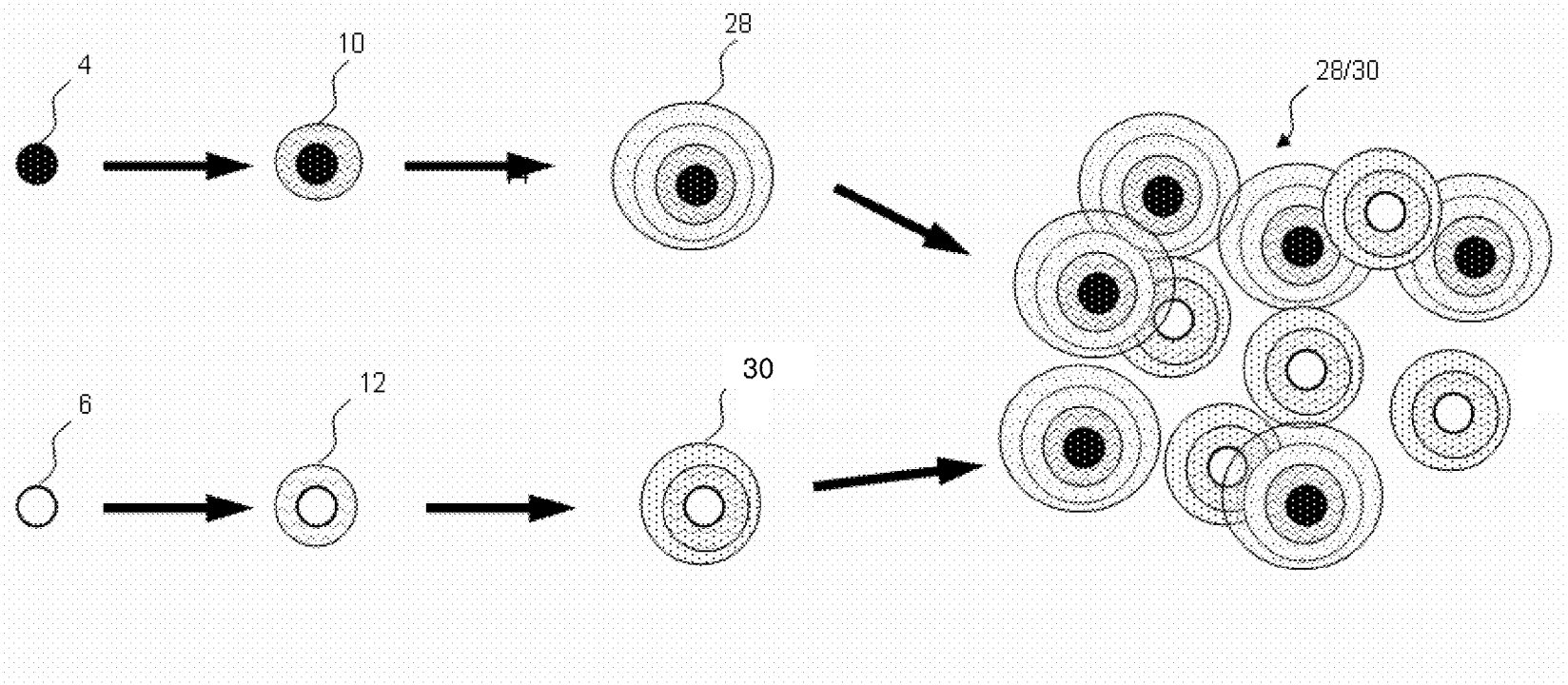
FIG. 2 is a schematic drawing of steps in producing coated particulates, according to the invention.

FIG. 2 shows steps in producing micro-engineered particulates 28/30, according to the invention. FIG. 2 corresponds to steps 102-104 of FIG. 1. Referring to FIG. 2, solid microspheres (powders) 4 and hollow microspheres 6 are chosen depending on the specific properties desired in the final composite. In the preferred embodiments, only medium and high strength hollow spheres are utilized (nominal ranges are 18 ksi, 30 ksi, 60 ksi and greater than 60 ksi).

The powders 4 and spheres 6 are then coated to produce coated powders 10 and coated spheres 12. The coatings are also powders and may be metallic, elements, alloys, co-deposited layers, and/or ceramic in nature. The coatings are separately mixed and blended with the powders 4 and spheres 6, respectively. The coatings are shown enlarged in FIG. 2 and are not drawn to scale; the actual coating thickness ranges from approximately 5 nanometers to 20 microns. The application of the coatings may further comprise the steps of chemical vapor deposition, physical vapor deposition, plasma deposition or other thermal spray, sol gel, electro deposition, electro less deposition, and/or ion beam. The coatings are selected on the basis of their ability to create or enhance specific desired properties in the final composite. For example, a tungsten coating increases modulus and tensile strength of the final composite. As another example, a carbide coating increases modulus of the final composite.

Referring to FIG. 2, multiple coatings of the powders 4 and spheres 6 also may be applied to form solids having multiple coatings 28 and spheres having multiple coatings 30. For example, an initial coating of tungsten followed by coatings of Al/Al203/Al aid in corrosion resistance and consolidation of lithium, magnesium and their alloys. As another example, a first coating of carbide followed by a second outer coating of aluminum aids in consolidation, while increasing modulus. As shown in FIG. 2, once the powders 28 and microspheres 30 are coated with the desired layers, the powders 28 and microspheres 30 are mixed to form the micro-engineered particulates 28/30 ready for use in consolidation. While FIG. 2 shows mixing of final particulates having multiple coatings 28/30, it should be understood that the micro-engineered particulates used for consolidation in the present invention may constitute core particles (both solid and hollow) without coatings (4/6), core particles (both solid and hollow) with a single coating (10/12), core particles (both solid and hollow) with multiple coatings (28/30) and any desired or suitable combination thereof. It also should be noted the invention may also cover the use of coated hollow sphere, powder or particle that is used by itself and not mixed with any other constituent to make the composite.

Figure 3A:
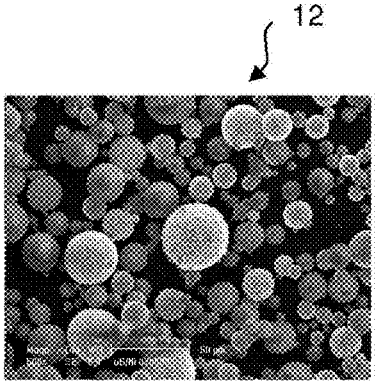
FIGS. 3A through 3D are four Scanning Electron Microscope views of exemplary micro-engineered particulates.
Figure 3B:
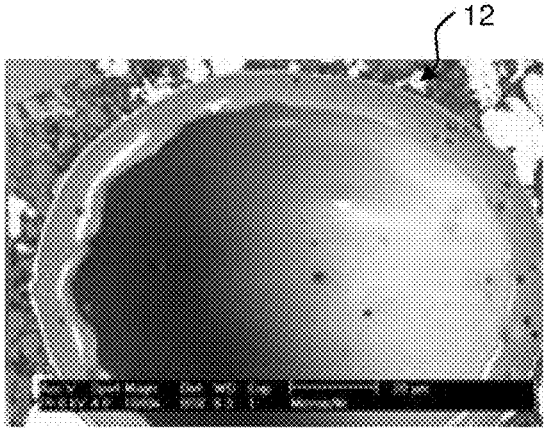

FIGS. 3A-3D show Scanning Electron Microscope views of exemplary microengineered particulates. FIG. 3A shows the surface of coated hollow microspheres 12, namely a glass microsphere coated with nickel (300 nm), according to the invention. FIG. 3B shows a Scanning Electron Microscope view of a cross-section of a coated hollow sphere from the sample shown in FIG. 3A. The thin nickel coating is visible as a thin white line encapsulating the microsphere 12.

Figure 3C:
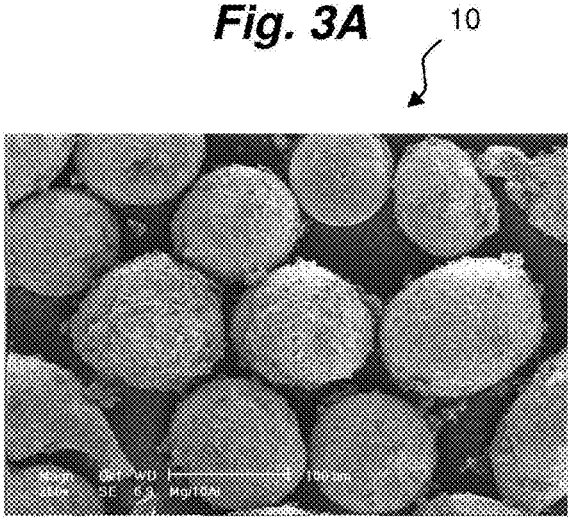

FIG. 3C shows a Scanning Electron Microscope view of an exemplary microengineered solid particulate comprising magnesium powder coated with aluminum 10 weight %, according to the invention.

Figure 3D:
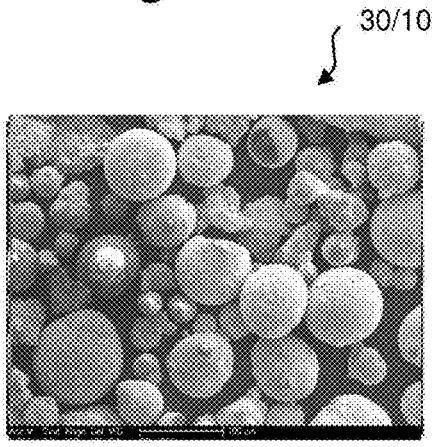

FIG. 3D shows a Scanning Electron Microscope view of exemplary micro-engineered particulates comprising 60 ksi microspheres with multiple coatings 30 having a single coating 10, according to the invention. The particulates shown in FIG. 3D comprise 60 ksi with coatings of tungsten carbide followed by a coating of aluminum.

Figure 3E:
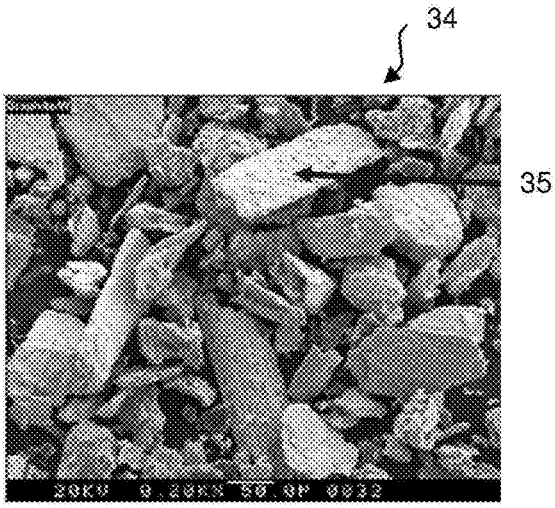
FIGS. 3E and 3F are two Scanning Electron Microscope views of an exemplary coated powder substrate morphology and cross-section.
Figure 3F:
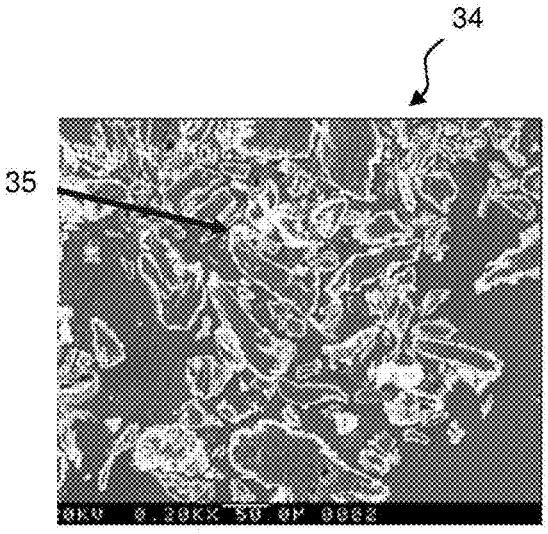

FIGS. 3E and 3F show Scanning Electron Microscope views of an exemplary powder substrate 34 morphology and cross-section. The substrate 34 shown is graphite coated in with tungsten 35. The coating 35 renders the graphite powder particles thicker as shown by the thicker white edges of the graphite particles in the cross-sectional view of FIG. 3F. One can then heat treat this powder and create a carbide exterior layer on the graphite powder varying from pure tungsten carbide to variations in stoichiometery ranging from pure tungsten carbide to pure tungsten.

Referring again to FIG. 2 and step 106 of FIG. 1, the selected micro-engineered particulates 4/6/10/12/28/30 are combined and mixed with the powder substrate 34 (coated or not coated) to form a nano design powder 32 (shown in FIG. 4) ready for consolidation. In an alternate embodiment, the selected micro-engineered particulates 4/6/10/12/28/30 are consolidated without use of a powder substrate 34; see, infra, section entitled "Alternate Embodiment."

Figure 4:
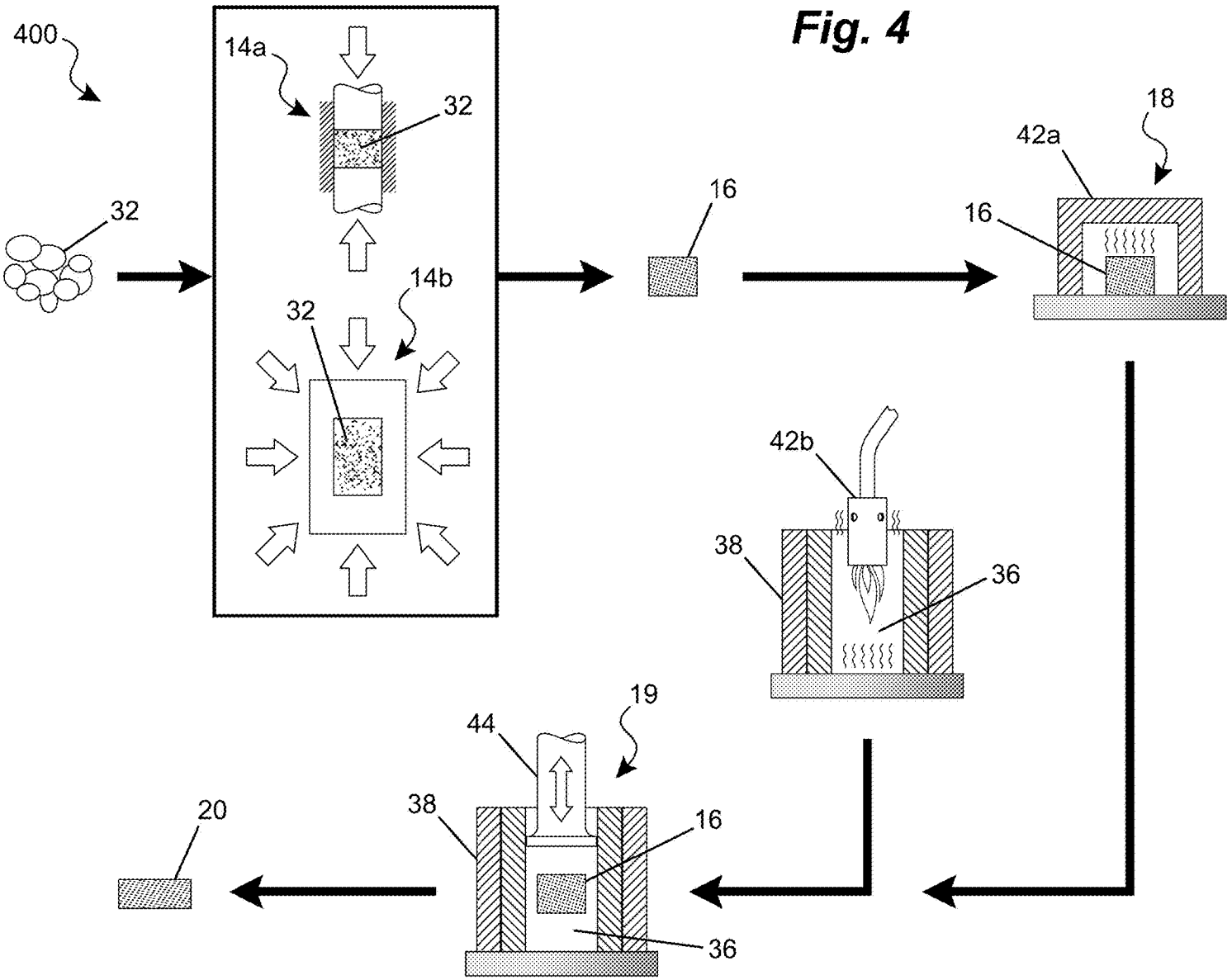
FIG. 4 is a schematic drawing of steps in the processes of pre-consolidation and consolidation, according to the invention.

FIG. 4 shows details for the novel process of consolidation 400 to achieve the application-specific metal matrix composites, according to the invention. FIG. 4 corresponds to steps 106 and 108 in FIG. 1. In general, the method shown in FIG. 4 carefully controls the rate and level of consolidation during the critical pressurization phase whereby the inherent strength of the coated hollow spheres or other particles is not unduly exceeded. By controlling both the rate and deformation (strain) introduced upon the coated hollow spheres, the desired structural and metallurgical integrity of the entire article may be maintained. In addition, the method utilizes novel solid-state processes that require no melting of the matrix. The consolidation processes are conducted at select temperatures to assure that the melting point of any of the materials involved is never reached.

As shown in FIG. 4, the nano design powder 32, comprising the micro-engineered particulates (4/6/10/12/28 and/or 30 as shown in FIG. 2) combined with the powder substrate (34 as shown in FIG. 3E), is initially pre-consolidated 14*a*/14*b* to form a near net shape article 16 (corresponding to step 106 of FIG. 1). This pre-consolidation step 14*a*/14*b* may be achieved through any suitable or desirable method, including without limitation, pressing in a hard die, Cold Isostatic Pressing, and metal injection molding. Pre-consolidation by pressing in a hard die is represented by 14*a*; pre-consolidation by an alternate method of cold isostatic pressing is represented by 14*b*. Pressure being applied to the nano design powder 32 is represented by block arrows.

Referring to FIG. 4, the near net shape article 16 is then consolidated in a two-step novel process 18/19 referred to herein as Dynamic Forging. The Dynamic Forging processes shown in FIG. 4 18/19 correspond to step 108 of FIG. 1.

The first mode of Dynamic Forging 18 involves powder particle re-alignment and packing at an applied pressure in the range of 5 to 200 Tons by a forge 38 (shown in step 19) containing heated pressure transmitting media ("PTM") 36. During this process 18, segment powder particles 32 are re-aligned and packed into a tighter configuration than as existed in the preform 16, thereby partially filling interstitial vacancies. A furnace 42*a* provides heat in a temperature range of from 100 degrees Centigrade to 1400 degrees Centigrade, with the maximum temperature not exceeding the melting point of any materials in the nano design powder 32. An increase in preform density will be achieved and may be limited to between 3% and 15%.

Referring to FIG. 4, concurrent to the heating of the powder preform 16 in furnace 42*a*, the forge 38 is also heated by means of an external, high energy output device 42*b*. In the case of the present invention, a specialized propane torch 42*b* capable of generating a minimum of 200,000 BTU/HR is utilized so as to minimize the thermal differential between the powder preform 16, the pressure transmitting media 36 and the forge 38. The duration of heating required for the forge 38 is dependent upon the composite material being consolidated but typically is not less than 10 minutes. Other forms of high energy output devices such as induction and resistance heating may also be used. Significant improvement upon prior art is thus obtained whereby near isothermal conditions exist prior to preform consolidation as a result of minimizing thermal decay between powder preform 16, pressure transmitting media 36 and forge 38. This improvement upon prior art prevents the thermal energy required for proper consolidation of matrix and particulates from prematurely dissipating from the powder preform. A "cold forge" is thus avoided and insures optimal consolidation conditions and resultant material properties.

Referring to FIG. 4, the near net shape article 16 is then subjected to a second mode of Dynamic Forging 19. In the second mode 19, the article 16 is subjected to an applied ram 44 and forge 38 pressure in the range of 2 to 2500 Tons with a controlled temperature range of 100 degrees Centigrade to 1400 degrees Centigrade within a PTM 36, again with the maximum temperature not exceeding the melting point of any materials in the nano design powder 32. The second mode 19 imparts a precisely controlled and specifically determined pressure on the article 16 that insures correct particle deformation, article densification and retention of particle morphology required to achieve the required physical and mechanical properties in the resulting metal matrix composite 20. This exact pressure is determined by analysis of microstructure, mechanical properties and desired structural integrity of the resultant composite 20. The exact pressure applied during the second mode 19 is determined by the starting article's 16 chemical and physical composition and is controlled by a series of integrated hydraulic valves, electrical relays and mechanical limit switches. In both the first and second modes 18/19, the pressurization rates are controlled between 2"/min and 120"/min, and the decompression rates are controlled so as not to exceed 120"/min.

Referring to FIG. 4, by utilizing only solid-state processes 14, 18, 19, the method prevents inter-facial reactions with the microspheres in the nano design powder 32 and avoids the detrimental effects due to oxidation of a molten matrix.

The solid-state process times are fast, none of the nano design powder 32 is fluidized, the microspheres cannot float or segregate, and there is no risk of an oxygen reactive liquid phase.

Moreover, the Dynamic Forging process 18/19 may be utilized to controllably crush a desired approximate percentage of hollow particulates to form a less or more porous composite, as desired. The strength of the composite (due to compression of hollow spheres) versus the weight of the composite (lighter depending on the amount of surviving hollow spheres) may be correlated to levels of compression. Fewer surviving spheres correlate to a higher structural strength; more surviving spheres correlates to a lighter weight composite. Consequently, both open/hollow spheres and crushed spheres provide enhancements to the composite and represent significant improvement over prior art metal matrix composites.

While the Dynamic Forging 18/19 method of the present invention is the preferred mode of consolidation, it should be understood that any suitable or desired method of consolidation, or combination thereof, may be utilized to increase the density of the near net shape article 16, including without limitation, P/M forging, Hot Isostatic Pressing, Laser Processing, sintering, pulse sintering, ARCAM, forging in a granular bed of particles, Metal Injection Molding, Laser-engineered Net Shaping, conventional forging in a mold, direct consolidation of powders by the use of rapid pressure molding, plasma process, thermal spray process, E-Beam Process, Squeeze casting, Liquid Phase Sintering with pressurization, Liquid Phase Sintering without pressurization, vacuum hot pressing, Electro-consolidation, extrusion and ECAP extrusion.

Figure 5:
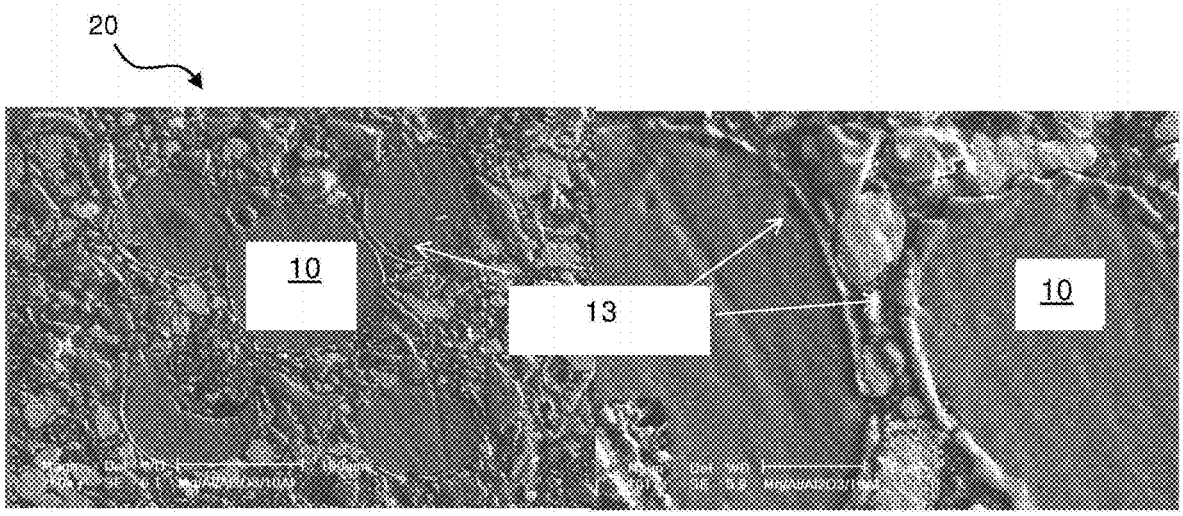
FIG. 5 is Scanning Electron Microscope cross-sectional views of an exemplary metal matrix composite produced according to the invention.

FIG. 5 shows two side by side Scanning Electron Microscope cross-sectional views of an exemplary metal matrix composite 20, produced according to the invention. The composite shown in FIG. 5 comprises solid magnesium particulates 10 coated with aluminum 13. As shown in FIG. 5, the structural integrity of the microspheres 10 has been maintained throughout the Dynamic Forging dual mode consolidation process 18/19.

Figure 6:
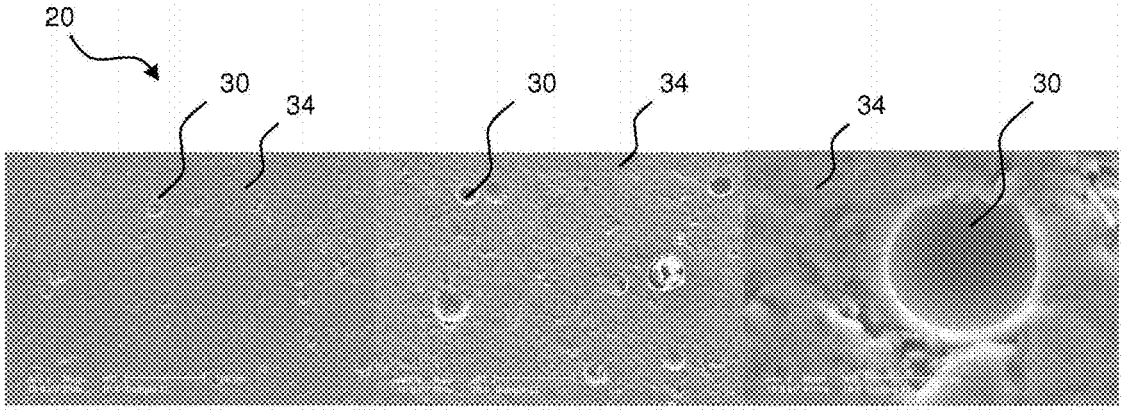
FIG. 6 is Scanning Electron Microscope cross-sectional views of an exemplary metal matrix composite produced according to the invention.

FIG. 6 shows a series of three Scanning Electron Microscope cross-sectional views of an exemplary metal matrix composite 20, produced according to the invention. The photographs show the microstructure of polished composite containing microengineered coated hollow spheres 30 embedded in the powder substrate 34 matrix. The example shown in FIG. 6 is 20% volume glass spheres 30 coated with Ni/W/Al in a magnesium substrate 34 matrix.

Figure 7A:
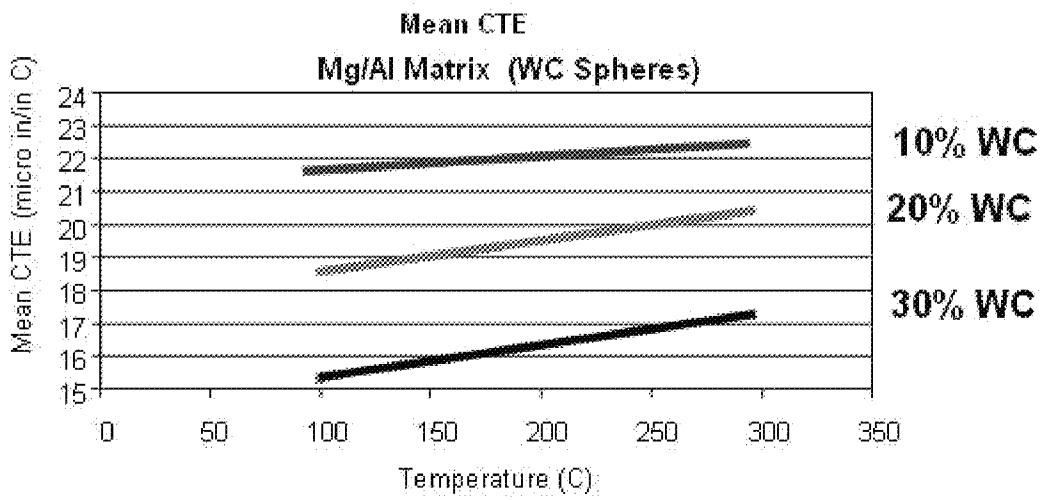
FIGS. 7A through 7D are four graphic representations of the control of the Coefficient of Thermal Expansion for composites produced according to the invention; and, FIGS. 8A and 8B are two graphic representations the control of the resulting tensile strength under different ram pressures for composites produced according to the invention.

FIGS. 7A through 7D show the controllable Coefficient of Thermal Expansion ("CTE") results of metal matrix composites 20 produced according to the invention. FIG. 7A shows the mean CTE of a composite comprising tungsten/carbon ("W/C") spheres in a magnesium/aluminum matrix with amounts of the microspheres at 10 percent, twenty percent and thirty percent respectively. The mean CTE of said composite constituting 10 percent WC ranges from approximately 21.5 to 22.5 across a temperature range from 100 to 300 degrees Celsius. The mean CTE of said composite constituting 20 percent WC ranges from approximately 18.5 to 20.5 across a temperature range from 100 to 300 degrees Celsius. The mean CTE of said composite constituting 30 percent WC ranges from approximately 15.5 to 17 across the same temperature range.

Figure 7B:
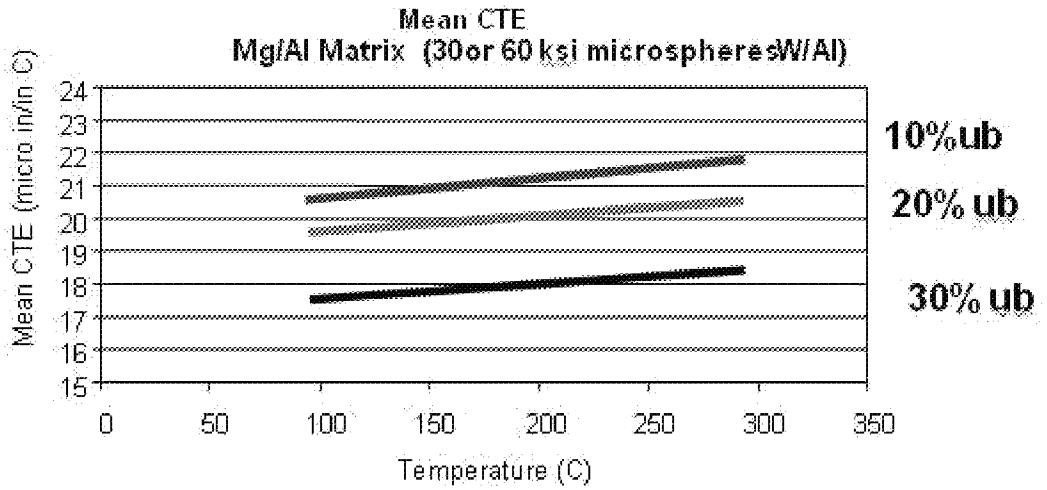

FIG. 7B shows the mean control of CTE of composites comprising variations in ceramic microspheres of 30 and 60 ksi crush strengths coated with tungsten and aluminum ("ub") in a magnesium/aluminum matrix with amounts of the microspheres at ten percent, twenty percent and thirty percent respectively. The mean CTE of said composite constituting 10 percent ub ranges from approximately 20.5 to 22 across a temperature range from 100 to 300 degrees Celsius. The mean CTE of said composite constituting 20 percent ub ranges from approximately 19.5 to 20.5 across a temperature range from 100 to 300 degrees Celsius. The mean CTE of said composite constituting 30 percent ub ranges from approximately 17.5 to 18.5 across the same temperature range.

Figure 7C:
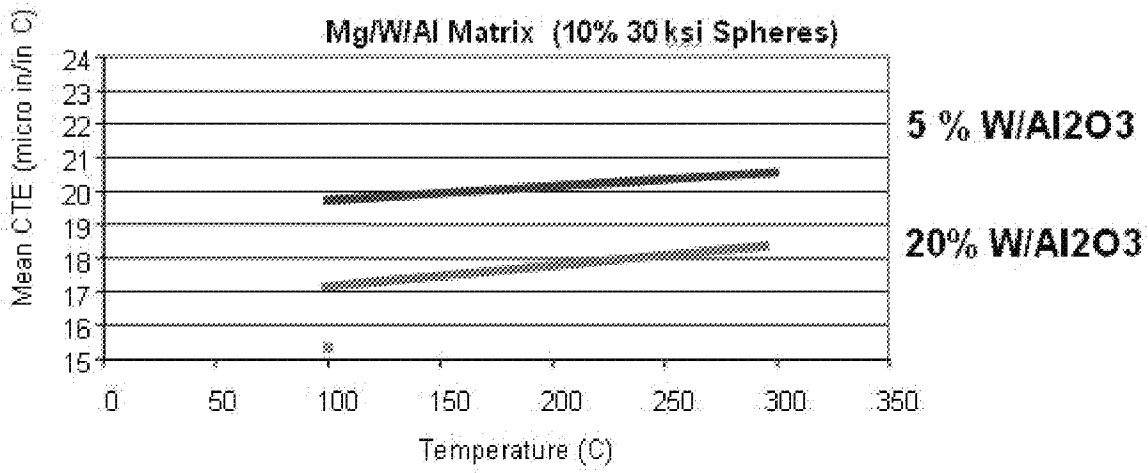

FIG. 7C shows the control of the mean CTE of a composite comprising 10 percent ceramic microspheres of 30 ksi crush strength in a magnesium/tungsten/aluminum matrix. The mean CTE of said composite constituting 5 percent W/Al203 ranges from approximately 20 to 20.5 across a temperature range from 100 to 300 degrees Celsius. The mean CTE of said composite constituting 20 percent W/Al203 ranges from approximately 17 to 18.5 across the same temperature range.

Figure 7D:
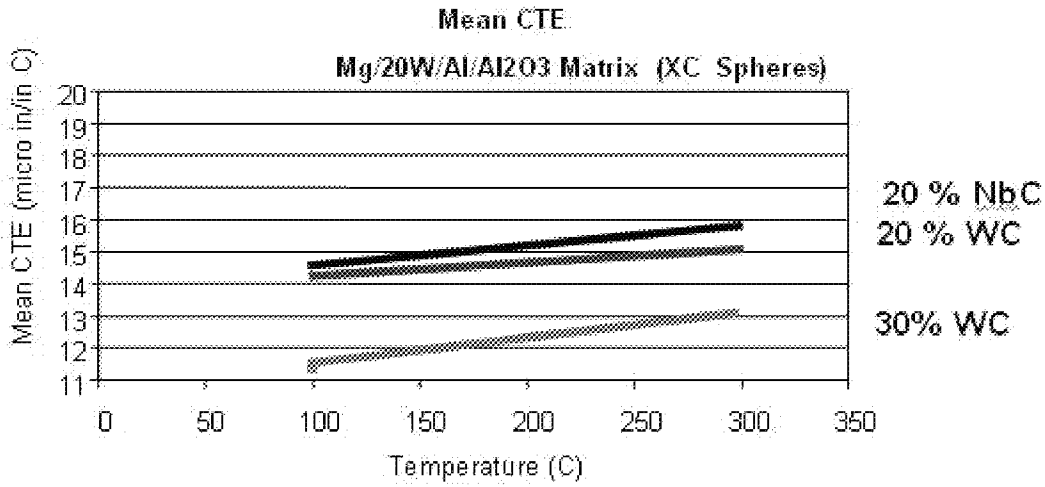

FIG. 7D shows the control of the mean CTE of composites comprising variations of microspheres in a Mg/20W/Al/Al203 matrix. The mean CTE of said composite constituting 20 percent NbC spheres ranges from approximately 14.5 to 16 across a temperature range from 100 to 300 degrees Celsius. The mean CTE of a composite constituting 20 percent WC spheres ranges from approximately 14 to 15 across a temperature range from 100 to 300 degrees Celsius. The mean CTE of a composite constituting 30 percent WC spheres ranges from approximately 11.5 to 13 across the same temperature range.

As can be seen from the results depicted in FIGS. 7A through 7D, the composites demonstrate a predictable mean CTE across temperature ranges.

Figure 8A:
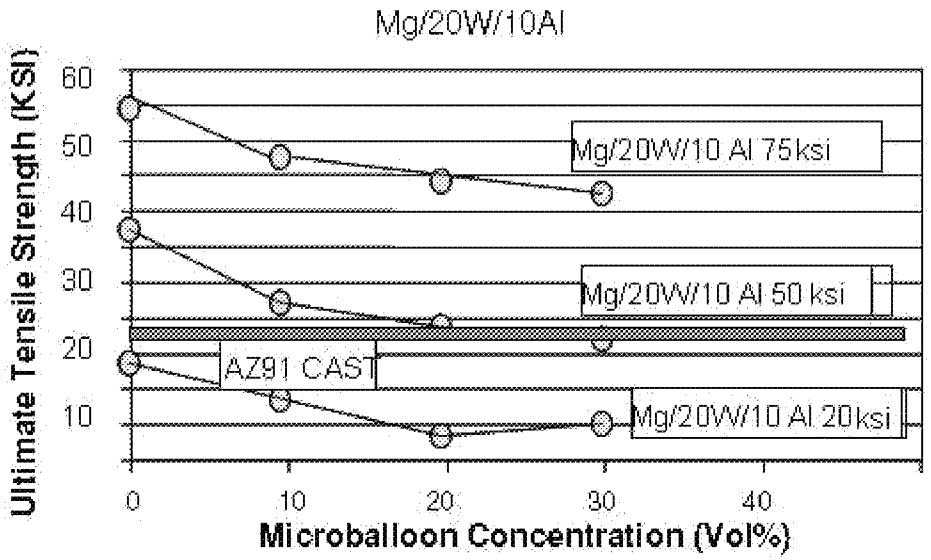
Figure 8B:
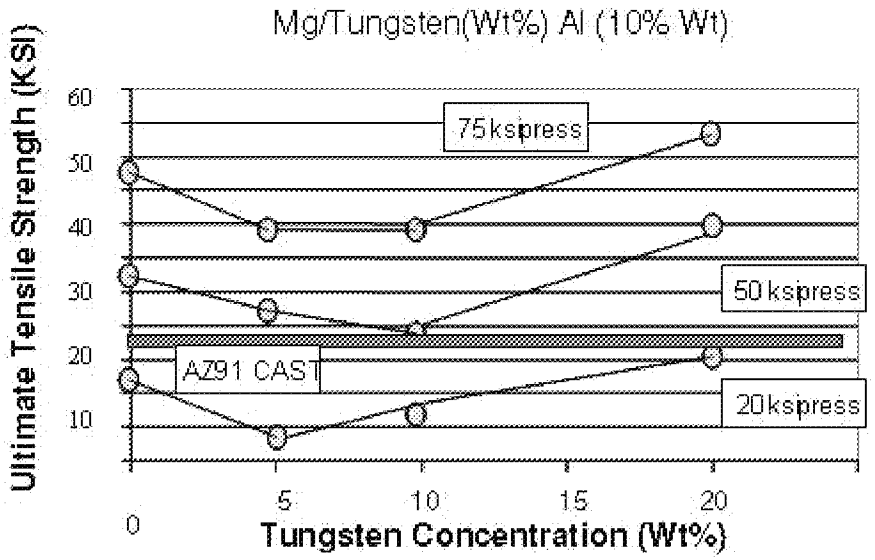

The novel metal matrix composites 20 of the present invention also exhibit controllable and predictable tensile strengths. FIGS. 8A and 8B show the results of tensile strength versus ram pressure utilized during Dynamic Forging for composites produced according to the invention. FIG. 8A plots the ultimate tensile strength (in ksi) against microballoon concentration by percent volume for three different composites. The first (top) composite of Mg/20W/10Al subjected to 75 ksi has a tensile strength ranging from approximately 55 to 42 across a range of microballoon concentrations from zero to 30 volume percent. The second (middle) composite of Mg/20W/10Al subjected to 50 ksi has a tensile strength ranging from approximately 37 to 25 across a range of microballoon concentrations from zero to 30 volume percent. The third (bottom) composite of Mg/20W/10Al subjected to 20 ksi has a tensile strength ranging from approximately 20 to 10 across the same range of microballoon concentrations. The tensile strength of AZ91 Cast is shown for comparative purposes as a solid bar at approximately 23 ksi. Consequently, the tensile strengths of the composites subjected to medium to high pressures (50 and 75 ksi) meet or exceed the tensile strength of AZ91 Cast.

Similar results are shown in FIG. 8B for tensile strengths of magnesium/tungsten/aluminum composites 20 produced according to the invention. FIG. 8B plots the ultimate tensile strength (in ksi) against tungsten concentration by percent weight for three different composites. The first (top) composite of Mg/W/10Al subjected to 75 ksi has a tensile strength ranging from approximately 47 to 54 across a range of tungsten concentrations from zero to 20 percent. The second (middle) composite of Mg/W/10Al subjected to 50 ksi has a tensile strength ranging from approximately 35 to 40 across a range of tungsten concentrations from zero to 20 percent. The third (bottom) composite of Mg/W/10Al subjected to 20 ksi has a tensile strength ranging from approximately 17 to 20 across the same range of tungsten concentrations. The tensile strength of AZ91 Cast is shown for comparative purposes as a solid bar at approximately 23 ksi. Consequently, the tensile strengths of the composites subjected to medium to high ksi (50 and 75) meet or exceed the tensile strength of AZ91 Cast.

Application Specific Properties

The following application specific properties using the method disclosed herein may be achieved singly or in combination:

Radiation Hardening: The addition of W, Ta or lead or high atomic number materials, to, for example, magnesium powder enables production of a lightweight composite capable of withstanding and shielding from prompt dose radiation of a nuclear exposure. Effective loadings are equal to DoD HAENS STD I, II or III levels.

X-Ray Shielding: The addition of W, Ta or lead to any powder enables production of a composite that shields X-Ray radiation.

Neutron Shielding: The addition of Boron, Lithium, Gadolinium, hydrides, carbides or other low atomic number elements produces a composite capable of shielding neutron sources.

Combined Radiation Effects: The addition of high atomic and low level atomic number materials to a base powder or hollow sphere will provide combined radiation shielding in one composite.

EMI Shielding: The addition of Nickel, tungsten or other materials to a material, such as Magnesium, produces a composite with EMI shielding without addition of external coatings.

Corrosion Resistance: The addition of Aluminum, tungsten, Zinc, or Aluminum Oxide to, for example, to Lithium or Magnesium, and its alloys provides a composite with corrosion resistance and moisture resistant properties not currently available.

Modulus Enhancement: The addition of microspheres (ceramic or metallic) and coated metal particles (W, Ni, Al or other coatings) increases modulus of a composite. The increases can be 5-100% depending on volume percent added into the composite. As a result, the powder substrate utilized can be heavier than the particulates, such as in the case of Lithium compounds and Magnesium. As an example, an addition of 2.2 gm/cm3 microspheres to Magnesium increases modulus/stiffness, lowers thermal conductivity, and reduces CTE.

Reduced Density: The addition of microspheres can reduce weight 10-60% over the metal or alloy. For example, Aluminum-based materials can have densities of 1.2-2.5 gm/cm3 depending on the amount included. Densities below 1 gm/cm3 and as low as 0.6 gm/cm3 have been achieved.

Thermal expansion reduction: The addition of microspheres or other elements such as Tungsten or Silicon to any composite reduces expansion 2-90%. Magnesium composite thermal expansion can be reduced from 27 down to 4 ppm/C, with the addition of Silicon, tungsten and microspheres.

Thermal conductivity variation: Changes in thermal conductivity can be slight or extreme depending on the size and type of microsphere. Aluminum composites can have a thermal conductivity variability of 200 W/mK or 20 W/mK depending on the type, amount added and size of the microsphere.

Higher Tensile Strength: The addition of elements such as Aluminum, Nickel, and Tungsten, for example, increase the tensile strength of Magnesium-based composites. Similar additions of Tungsten or Nickel to an Aluminum matrix result in tensile strength increases also.

Increased Specific Strength: Increased specific strength is provided through the addition of higher tensile strength materials such as Ni, W, Ti and Al based materials. These elements or compounds of each increase tensile strength while the microspheres decrease the overall density of say for example, Magnesium based composites. This increase of tensile strength and the decrease in density results in an overall increase in specific strength;

Improved Surface Finish: The addition of 10% or 20% microspheres of 5 microns or less in size improves the surface finish and creates a diamond turned material for mirror or other purposes. This has been achieved with Li, Li based alloys, Mg, Mg alloys, Al, Al Alloys, and each coated with tungsten, aluminum or a combination of coatings in a composite.

Improved Safety in Handling: The metal matrix composite materials resulting from micro-engineered particulates dynamically forged upon a beryllium-based substrate are less prone to pose a safety hazard to handlers.

Combinations of the above properties are possible for a given composition. For example, the addition of Tungsten or tungsten carbide coated microspheres increases tensile strength, provides radiation shielding, reduces CTE and increases modulus all in the same composition.

Table I below summarizes some exemplary properties (column 1) of various composites formed according to the invention under ram pressures of 20 ksi ("Ub" in Table 1 refers to microspheres volume).

TABLE I

| Property | Mg/10 W Al203 | Ub 30 ksi 10% | Ub 30 ksi 20% | Ub 30 ksi 30 | 20/W/30% Vol WC/Gr |
|---|---|---|---|---|---|
| Density (g/cm3) | 1.95 | 1.85 | 1.75 | 1.65 | 1.97 |
| Tensile Strength (ksi) | 17 | 14 | 12 | 9 | 12 |
| Modulus (msi) | 16 | 18 | 20 | 23 | 25 |
| CTE (PPM/C) | 21-22 | 20-21 | 19-21 | 18-20 | 12-15 |
| Thermal Cond. (W/mk) | 180 | 160 | 135 | 110 | 122 |

As can be seen from the results depicted in Table I, the composites produced according to the invention are highly variable and controllable for these specific properties.

Table II below compares properties of AZ 91C Cast Mag (column 2) against the same property qualities of exemplary composites produced according to the invention.

TABLE II

| Property | AZ 91 C Cast Mag | Mg/10-15 Al | Mg/10 Al with micro-spheres | Mg/W/Al | Mg/W/Al with micro-spheres |
|---|---|---|---|---|---|
| Density (g/cm3) | 1.75 | 1.80 | 1.4-1.7 | 1.8-1.95 | 1.6-1.7 |
| Ultimate Tensile (ksi) | 28 | 17-48 | 15-31 | 17-62 | 13-31 |
| Thermal Cond. (W/mk) | 80 | 124-140 | 100-122 | 130-152 | 110-122 |
| CTE (PPM/C) | 26 | 22-24 | 21-24 | 17-22 | 16-20 |

As can be seen from the results depicted in Table II, various properties of the composites produced according to the invention are comparable or exceed the properties of AZ 91 C Cast Mag.

Alternate Embodiment

The present method may alternately involve production of a composite comprising micro-engineered particulates with or without use of a powder substrate, the method comprising the steps of: 1) selecting at least one micro-engineered particulate; 2) coating the particulate with at least one material selected from the group consisting of metals, alloys, element, polymers and ceramics; 3) inserting the particulate into a form; and, 4) forging, sintering or consolidating the particulate to form a composite. Depending on the level of pressure applied during consolidation or Dynamic Forging 18/19, the composite may have varying levels of porosity. Where hollow particulates are utilized, the Dynamic Forging 18/19 process may be utilized to controllably crush a desired approximate percentage of the particulates to form a less porous composite.

INDUSTRIAL APPLICABILITY

It is clear that the invention described herein has wide applicability to the aerospace, automotive, medical and many other industries, namely to provide truly satisfactory metal-based composite substitutes exhibiting tailored properties. Numerous opportunities exist for materials with improved specific properties, such as increased strength, corrosion resistance, shielding capability, lower density, and so on, for aircraft, missiles, electronics, and other aerospace, automotive, DoD or commercial applications. Significantly, the materials may be tailored to exhibit either an increase or decrease in properties, as desired. A main focus of use for these materials is as replacement for aluminum, beryllium, magnesium, silicon carbide, ceramic glasses, Gr/Epoxy polymers, HAENS I, II, III type materials, and titanium and nickel based alloys.

It should be understood that various modifications within the scope of this invention can be made by one of ordinary skill in the art without departing from the spirit thereof and without undue experimentation. This invention is therefore to be defined as broadly as the prior art will permit, and in view of the specification if need be, including a full range of current and future equivalents thereof.

We claim:

1. A metal matrix composite material comprising a plurality of solid or hollow particulates, said plurality of particulates being metal particulates, wherein said plurality of particulates include particulates that are encapsulated in at least two coating layers of different materials, wherein said particulates are Magnesium particulates, and wherein said at least two coating layers of different materials are selected from the group consisting of a W coating layer, a Al coating layer, and a $Al_2O_3$ coating layer.

2. The material of claim 1, wherein said at least two coating layers include a $Al_2O_3$ coating layer.

3. The material of claim 1, wherein said at least two coating layers include an Al coating layer.

4. The material of claim 1, wherein said at least two coatings include a W coating layer.

5. The material of claim 4, wherein a coating layer of Al is disposed outside of the coating layer of W.

6. The material of claim 1, wherein said at least two coating layers include a coating layer of $Al_2O_3$ between two coating layers of Al, wherein the two coating layers of Al comprise the same material.

7. The material of claim 6, wherein said at least two coating layers further include a coating layer of W between the particulates and the coating layer of $Al_2O_3$ and the two coating layers of Al.

8. The material of claim 1, wherein said at least two coating layers include a coating layer of W and a coating layer of Al disposed outside of the coating layer of W, said metal matrix further including a concentration of metal microballoons ranging between 0 and 30 volume %.

9. The material of claim 1, wherein said at least two coating layers include a coating layer of W and a coating layer of Al disposed outside of the coating layer of W, said metal matrix further including less than 20% by weight concentration of W.

10. The material of claim 9, wherein said coated particulate is 10% by weight Al and said metal matrix is characterized by an ultimate tensile strength between 17 and 54 KSI.

11. The metal matrix composite material of claim 1, wherein said plurality of particulates include particulates that are solid or hollow metal particulates or are solid or hollow metal alloy particulates microspheres, wherein each coating layer is characterized by a corrosion resistance property and wherein the at least two coating layers are ordered such that a first coating layer is positioned closer to the core particle than a second coating layer and imparts an increased corrosion resistance property on the metal matrix composite material relative to the second coating layer.

12. The metal matrix composite material of claim 11, wherein said plurality of particulates include particulates that are hollow metal particulates or are hollow metal alloy particulates microspheres.

13. The metal matrix composite material of claim 1, wherein the particulates are encapsulated in at least three coating layers of different materials, wherein the at least three coating layers of different materials are characterized by different corrosion resistance properties.

14. The metal matrix composite material of claim 13, wherein the plurality of particulates comprise metal microballoons.

15. The material of claim 13, wherein the material includes:

tungsten microspheres embedded in a magnesium/aluminum matrix.

16. The material of claim 13, wherein the coating layers include a Tungsten coating layer.

17. The material of claim 1, wherein the particulates are sintered or consolidated.

18. The material of claim 1, wherein said composite material consists of said coated particulates sintered together.

19. The material of claim 1, wherein coated particulates are consolidated in solid-state.

20. The material of claim 1, wherein the at least two coating layers are arranged to provide the metal matrix composite material with corrosion resistance.

21. An article, the article comprising:

a metal matrix composite material comprising Magnesium particulates;

at least two different coating layers on the Magnesium particulates, the at least two different coating layers selected from the group consisting of: a W coating layer, an Al coating layer, and an $Al_2O_3$ coating layer;

wherein the at least two different coating layers are arranged to provide the metal matrix composite material with corrosion resistance.

22. The article of claim 21, wherein the article comprises:

a first coating layer of Al on the Magnesium particulates, a second coating layer of W on the first coating layer, and a third coating layer of $Al_2O_3$ on the second coating layer.

23. A metal matrix composite material, the material comprising:

Magnesium particulates;

two different coating layers on the Magnesium particulates, each of the two different coating layers selected from the group consisting of: a coating layer comprising W, a coating layer comprising Al, and a coating layer comprising $Al_2O_3$.

24. The material of claim 23, wherein the two different coating layers comprise a coating layer comprising W.

25. The material of claim 23, wherein the two different coating layers comprises a coating layer comprising Al.

* * * * *